US011260256B2

(12) United States Patent
Hsu

(10) Patent No.: US 11,260,256 B2
(45) Date of Patent: Mar. 1, 2022

(54) SYMMETRIC UPRIGHT ROTATING DISC EXERCISE MACHINE

(71) Applicant: GREAT FITNESS INDUSTRIAL CO., LTD., Tainan (TW)

(72) Inventor: Chih-Yung Hsu, Tainan (TW)

(73) Assignee: Great Fitness Industrial Co., Ltd., Tainan (TW)

( * ) Notice: Subject to any disclaimer, the term of this patent is extended or adjusted under 35 U.S.C. 154(b) by 43 days.

(21) Appl. No.: 16/902,765

(22) Filed: Jun. 16, 2020

(65) Prior Publication Data

US 2021/0387039 A1 Dec. 16, 2021

(51) Int. Cl.

| | |
|---|---|
| ***A63B 21/015*** | (2006.01) |
| ***A63B 21/00*** | (2006.01) |
| ***A63B 21/22*** | (2006.01) |
| ***A63B 23/12*** | (2006.01) |
| ***A63B 23/035*** | (2006.01) |
| ***A63B 71/06*** | (2006.01) |

(52) U.S. Cl.

CPC ..... *A63B 21/015* (2013.01); *A63B 21/151* (2013.01); *A63B 21/22* (2013.01); *A63B 21/4035* (2015.10); *A63B 21/4049* (2015.10); *A63B 23/03541* (2013.01); *A63B 23/1209* (2013.01); *A63B 2071/0658* (2013.01); *A63B 2225/09* (2013.01)

(58) Field of Classification Search

CPC ..... A63B 21/015; A63B 21/151; A63B 23/03541; A63B 23/1209; A63B 21/4049; A63B 21/4035; A63B 21/22; A63B 2225/09; A63B 2071/0658

See application file for complete search history.

(56) References Cited

U.S. PATENT DOCUMENTS

| | | | | |
|---|---|---|---|---|
| 3,079,914 | A * | 3/1963 | Bush | A61H 1/02 601/23 |
| 5,964,684 | A * | 10/1999 | Sokol | A63B 21/068 482/130 |
| 7,066,868 | B2 * | 6/2006 | Van Den Heever | A63B 21/0615 482/142 |
| 7,223,215 | B2 * | 5/2007 | Bastyr | A63B 23/03525 482/115 |
| 9,381,401 | B2 * | 7/2016 | Lampert | A61H 1/0274 |
| 10,569,122 | B2 * | 2/2020 | Johnson | A61H 1/0214 |
| 2004/0157711 | A1 * | 8/2004 | Regev | A63B 21/157 482/142 |

(Continued)

FOREIGN PATENT DOCUMENTS

TW M594972 U 5/2020

*Primary Examiner* — Andrew S Lo

(74) *Attorney, Agent, or Firm* — Rosenberg, Klein & Lee

(57) ABSTRACT

A symmetric upright rotating disc exercise machine includes a base unit and two upright rotating disc units. Each upright rotating disc unit includes a rotating shaft, an upright disc, and a grip. The rotating shaft is pivotally connected to the base unit in a horizontal direction. The upright disc is mounted to the rotating shaft. The upright discs of the two upright rotating disc units are arranged to face each other. The two upright rotating disc units are separated from each other by a distance in the horizontal direction to form an operation space. The grip is mounted to the upright disc and located in the operation space.

13 Claims, 11 Drawing Sheets

(56) References Cited

U.S. PATENT DOCUMENTS

| | | | | |
|---|---|---|---|---|
| 2005/0266969 | A1* | 12/2005 | Karafa | A63B 21/055<br>482/126 |
| 2015/0246264 | A1* | 9/2015 | Lampert | A63B 21/1465<br>482/4 |
| 2015/0314157 | A1* | 11/2015 | Lampert | A63B 21/1469<br>482/3 |
| 2017/0282002 | A1* | 10/2017 | Lee | A63B 71/0619 |
| 2019/0126090 | A1* | 5/2019 | O'Connor | A63B 24/0087 |

* cited by examiner

SYMMETRIC UPRIGHT ROTATING DISC EXERCISE MACHINE

FIELD OF THE INVENTION

The present invention relates to a symmetric upright rotating disc exercise machine, and more particularly to an exercise machine having two upright rotating disc units that are separated from each other by a distance in a horizontal direction to form an operation space for a user to operate the exercise machine.

BACKGROUND OF THE INVENTION

Nowadays, people pay more attention to sports to keep the body, not limited to outdoor sports. Generally, exercise equipment used for indoor sports includes treadmills, exercise bikes, elliptical machines, etc. The above-mentioned exercise equipment only exercises the muscles of the lower body, and the upper body cannot be fully exercised.

For the exercise equipment to exercise a user's upper body, the user needs to face the exercise equipment when in use. Taiwan Utility Model Publication No. M594972, titled "Multi-Function Exercise Machine", includes a frame, a leg training device, a hand training device, a resistance unit, a connecting unit, and a seat. The frame is provided with a push device. The push device includes two horizontal discs. However, the two horizontal discs can only perform "horizontal rotation" training for the user's hands. Due to the boxer's rapid swinging action on the punching bag, the boxer quickly swings his/her hands nearly vertically. If the user wants to do boxing training similar to the punching of the punching bag of the boxer, the push device of the above multi-function exercise machine is not suitable.

SUMMARY OF THE INVENTION

The primary object of the present invention is to provide a symmetric upright rotating disc exercise machine, comprising a base unit and two upright rotating disc units. Each upright rotating disc unit includes a rotating shaft, an upright disc, and a grip. The rotating shaft is pivotally connected to the base unit in a horizontal direction. The upright disc is mounted to the rotating shaft. The upright discs of the two upright rotating disc units are separated from each other by a distance in the horizontal direction to form an operation space. The grip is mounted to the upright disc and located in the operation space.

Preferably, the symmetric upright rotating disc exercise machine further comprises two resistance units disposed on the base unit. The two resistance units are connected to the two upright rotating disc units, respectively.

Preferably, each resistance unit includes a transmission wheel, a resistance wheel, a belt, a resistance member, a first elastic member, a cable member, and a control member. The transmission wheel is mounted to the rotating shaft. The resistance wheel is pivotally connected to the base unit. The belt connects the transmission wheel and the resistance wheel. The resistance member has a first end and a second end. The first end is pivotally connected to the base unit. The first elastic member is connected between the base unit and the second end. The resistance member corresponds to the resistance wheel. The cable member is connected between the second end and the control member. The control member is disposed on the base unit. The control member is configured to pull the resistance member through the cable member for controlling the resistance member to be in contact with the resistance wheel.

Preferably, the base unit includes a base and two brackets. The two upright rotating disc units are disposed on the two brackets, respectively. The two brackets are movably disposed on two sides of the base respectively so that the two brackets can be displaced along the horizontal direction to change the distance.

Preferably, the base includes a slide rail and a first fixing member. Each bracket includes a slide block and a second fixing member. The slide block is connected to the slide rail. The second fixing member corresponds to the first fixing member. The slide block is movable on the slide rail to drive the two brackets to move along the horizontal direction. The two brackets are secured to the base through the second fixing member to be fixed to the first fixing member.

Preferably, the slide rail is provided with a guide rod extending along the horizontal direction. The slide block is provided with a sleeve extending along the horizontal direction. The sleeve is sleeved on the guide rod. The sleeve is movable on the guide rod to drive the two brackets to move along the horizontal direction.

Preferably, the first fixing member is a rod member extending along the horizontal direction. The rod member has a plurality of fixing holes arranged along the horizontal direction. The second fixing member has a pressing member, a second elastic member, and a fixing rod. The pressing member has a pressing end, a control end, and a pivoting portion. The pivoting portion is pivotally connected to the bracket. The control end is connected to the fixing rod. The second elastic member is sleeved on the fixing rod. The fixing rod has a flange. The second elastic member is connected between the control end and the flange. When the fixing rod is inserted one of the fixing holes, the two brackets are fixe to the base. When the pressing end is pressed, the fixing rod is moved away from the fixing hole to release the two brackets from the base.

Preferably, the symmetric upright rotating disc exercise machine further comprises a seat disposed on the base. The seat is located on either side of the operation space and is away from the two upright rotating disc units.

Preferably, the symmetric upright rotating disc exercise machine further comprises a display unit disposed on the base unit.

According to the above technical features, the following effects can be achieved:

1. In the present invention, the two upright disc units are separated from each other by a distance in the horizontal direction to form the operation space. The two grips are relatively located in the operation space. The user can operate the two upright disc units with both hands to exercise his/her arms in the operation space. The exercise machine is suitable to exercise the upper limbs for boxers or other users or to rehabilitate the upper limbs of patients.

2. The two upright disc units of the present invention are provided with the resistance units, and the training intensity can be controlled by adjusting the resistance units.

3. The resistance units of the two upright disc units are set independently. When the resistances of the two upright turning disc units are the same, the left training intensity and the right training intensity are the same; when the resistances of the two upright turning disc units are different, the left training intensity and the right training intensity are different, that is, the left is strong and the right is weak, or, the left is weak and the right is strong.

4. The base unit of the present invention has the two brackets and the base, and the slide block of the bracket is movable on the slide rail of the base to adjust the operation space. By fixing the second fixing member to the first fixing member, the bracket is fixed to the base. The operation space can be adjusted according to the size of the user.

DETAILED DESCRIPTION OF THE PREFERRED EMBODIMENTS

Embodiments of the present invention will now be described, by way of example only, with reference to the accompanying drawings.

Figure 1:
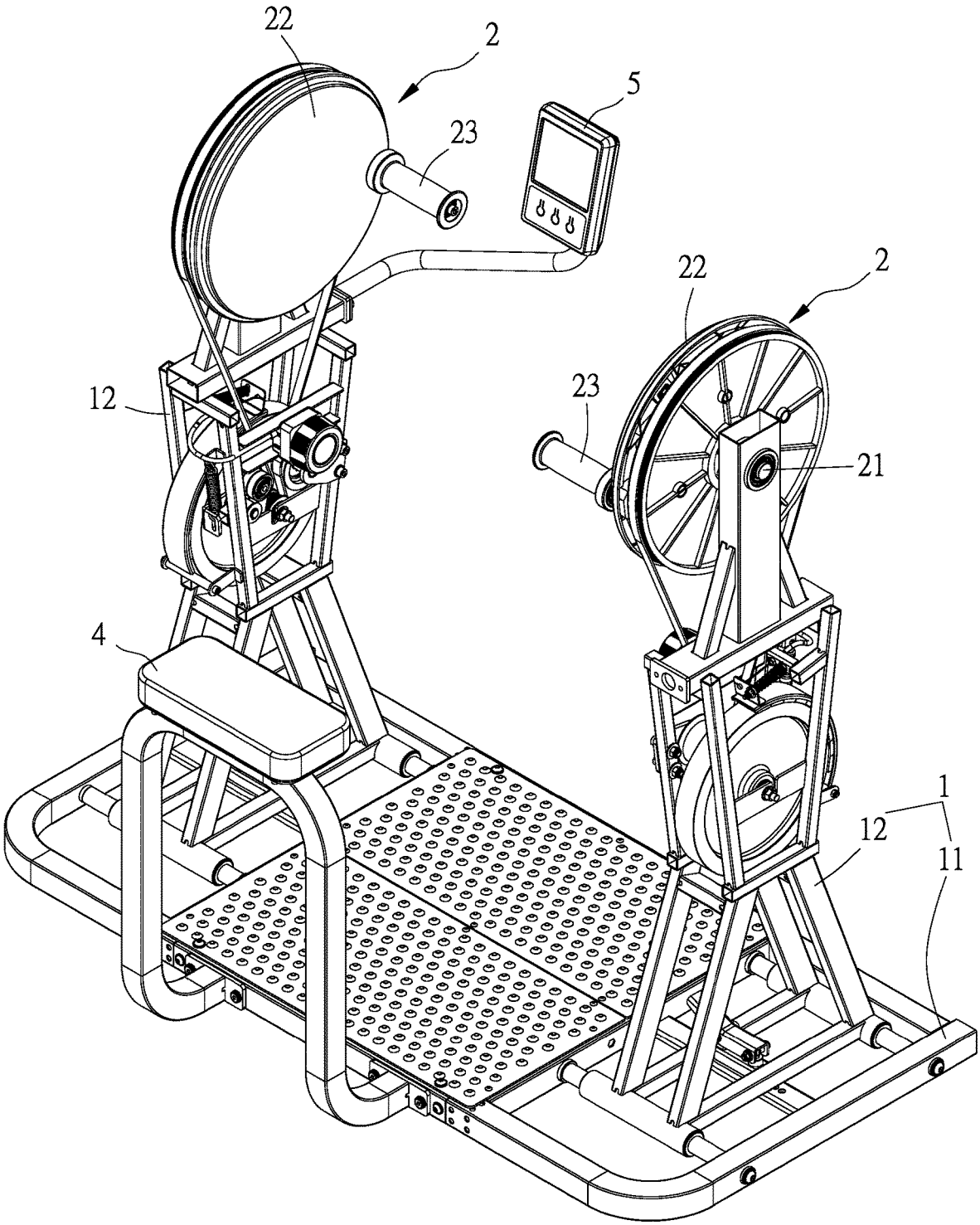
FIG. 1 is a perspective view of the symmetric upright rotating disc exercise machine of the present invention.

As shown in FIG. 1, the present invention discloses a symmetric upright rotating disc exercise machine, comprising a base unit 1, two upright rotating disc units 2, a seat 4, and a display unit 5. The base unit 1 includes a base 11 and two brackets 12. The two brackets 12 are disposed on two sides of the base 11, respectively. The two upright rotating disc units 2 are disposed on the two brackets 12, respectively. Each upright rotating disc unit 2 includes a rotating shaft 21, an upright disc 22, and a grip 23. The rotating shaft 21 is pivotally connected to the bracket 12. The upright disc 22 is mounted to the rotating shaft 21. The grip 23 is rotatably connected to the upright disc 22. The seat 4 is disposed on the base 11. The display unit 5 is disposed on one of the brackets 12. The seat 4 is opposite to the display unit 5.

Figure 2:
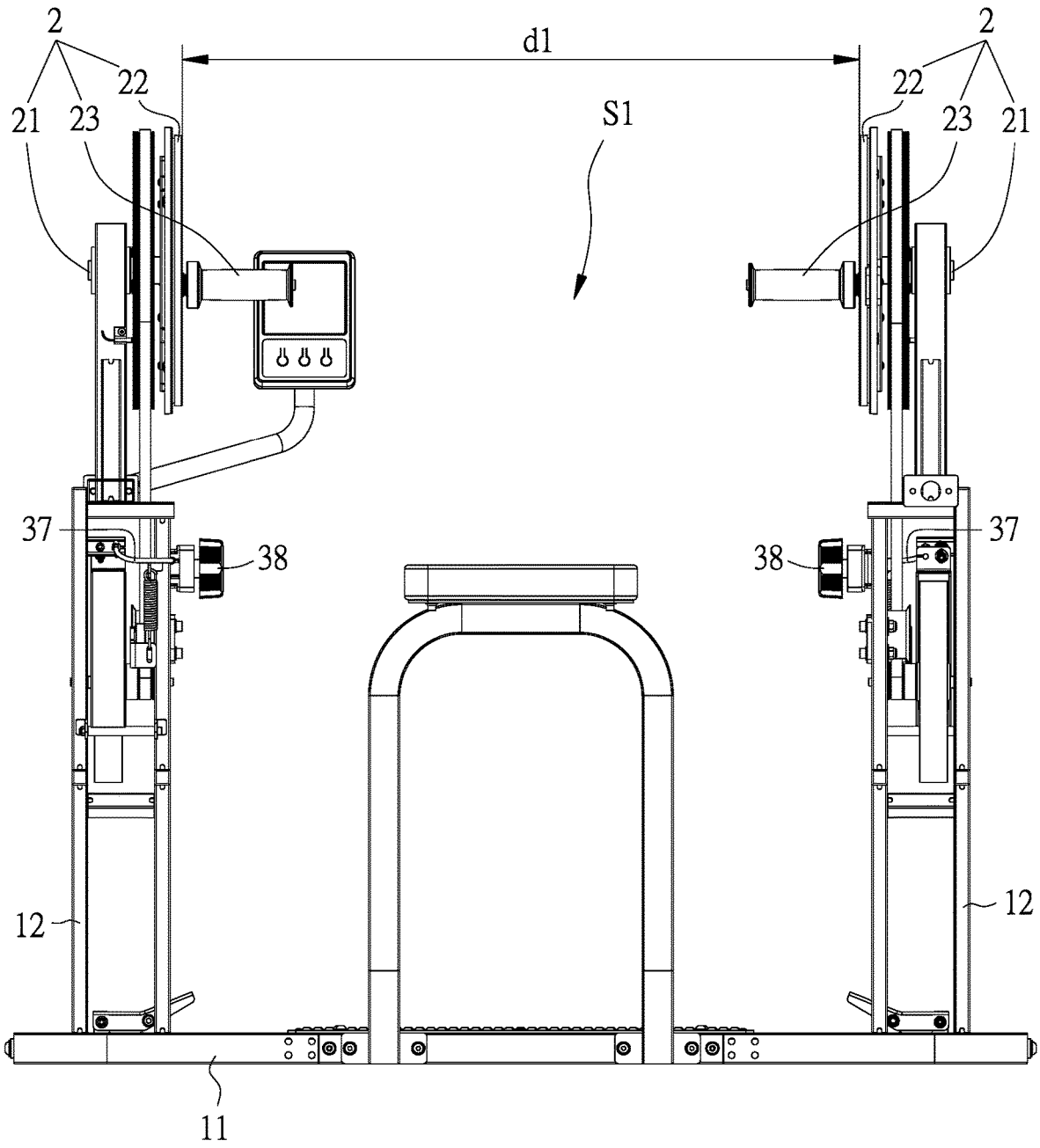
FIG. 2 is a front view of the symmetric upright rotating disc exercise machine of the present invention.

Please refer to FIG. 2. The rotating shaft 21 is pivotally connected to the bracket 12 in a horizontal direction. The two upright discs 22 are mounted to the two rotating shafts 21, respectively. The two upright discs 22 are arranged to face each other. The two upright discs 22 are separated from each other by a first distance d1 in the horizontal direction to form a first operation space S1. The two grips 23 are relatively located in the first operation space S1.

Figure 3:
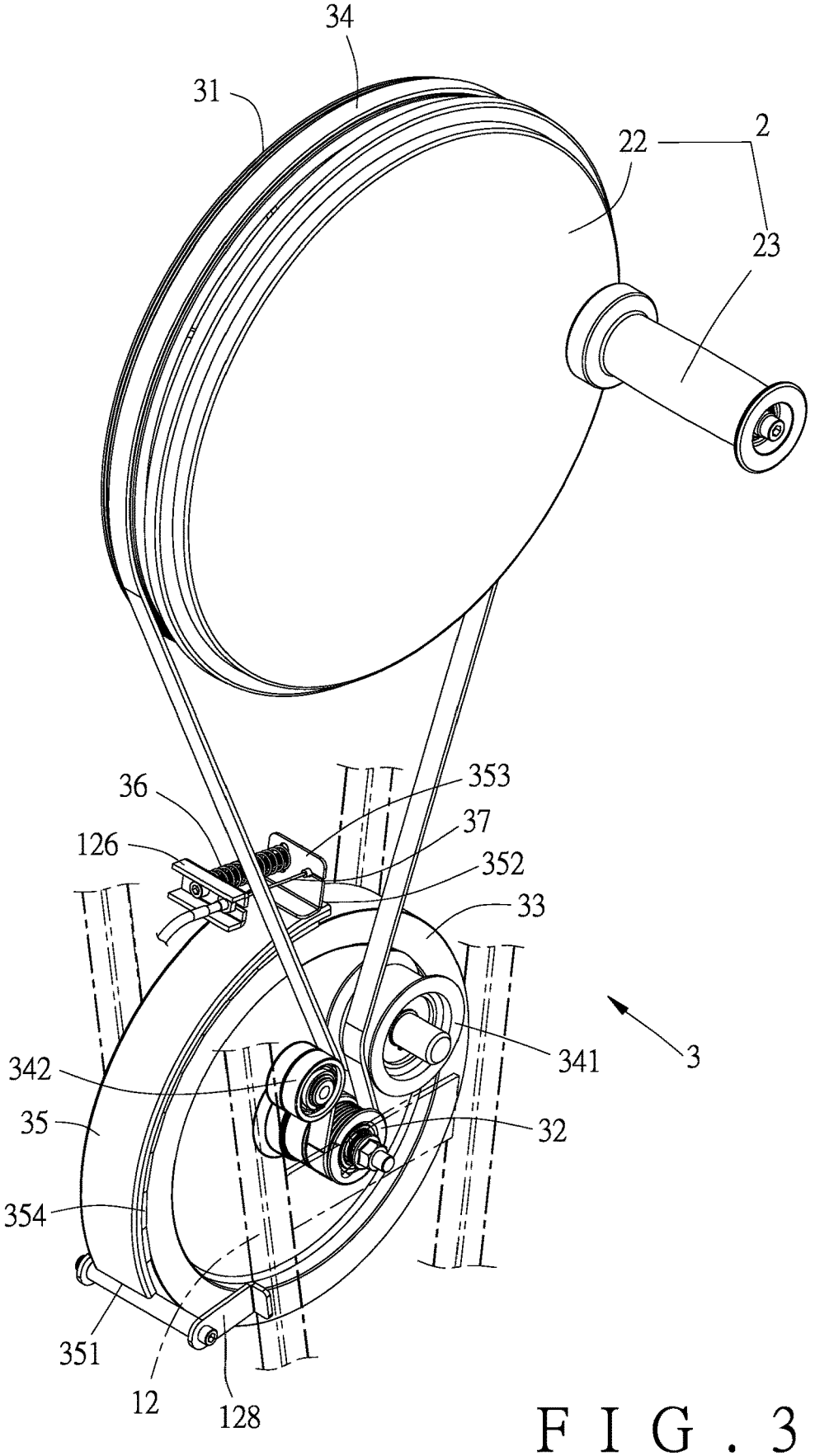
FIG. 3 is a perspective view of the upright rotating disc unit connected with the resistance unit of the present invention.
Figure 4:
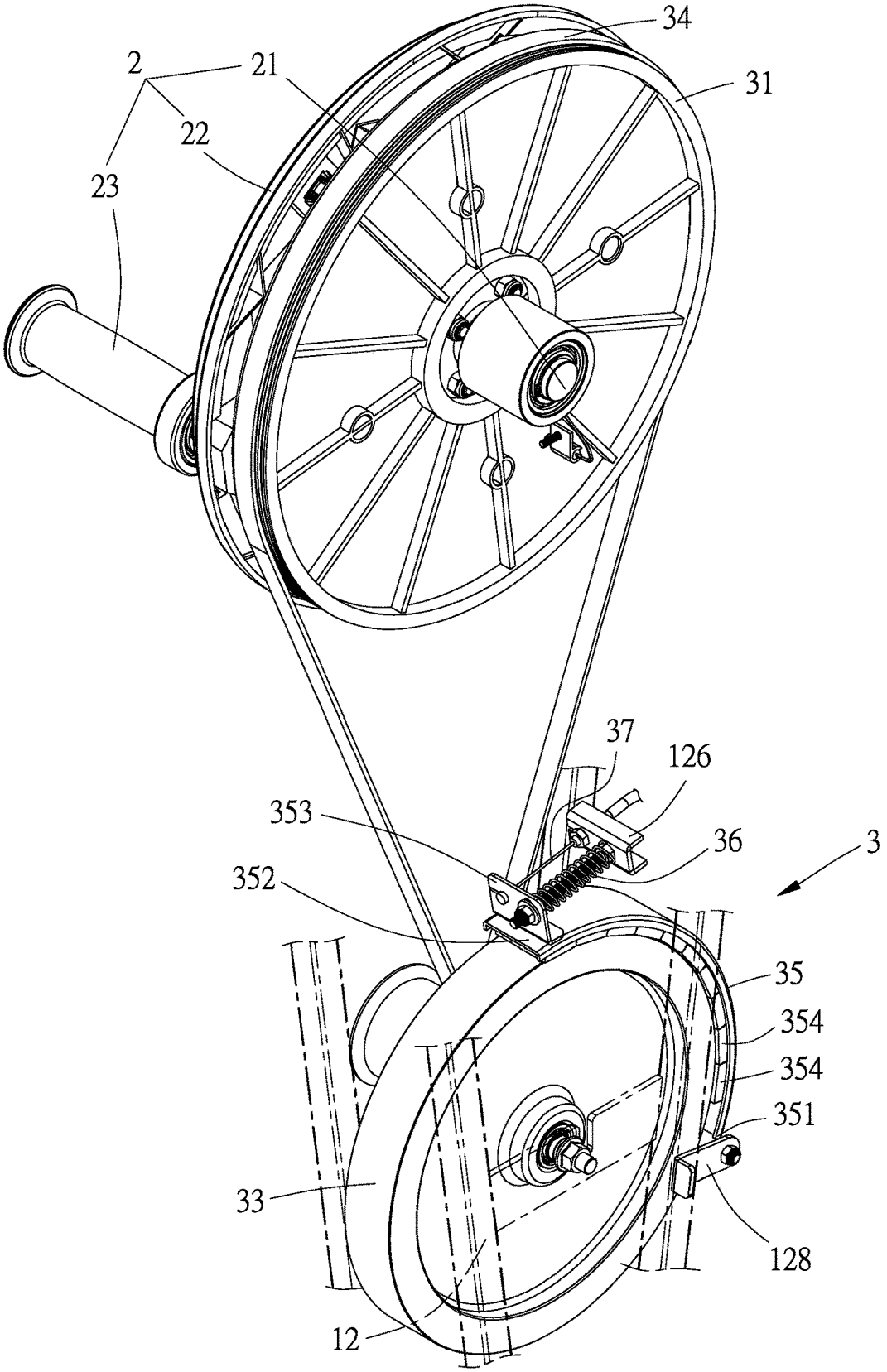
FIG. 4 is another perspective view of the upright rotating disc unit connected with the resistance unit of the present invention.

Please refer to FIGS. 2-4. Each upright rotating disc unit 2 is provided with a resistance unit 3. The resistance unit 3 includes a transmission wheel 31, a rotating wheel 32, a resistance wheel 33, a belt 34, a resistance member 35, a first elastic member 36, a cable member 37, and a control member 38. The transmission wheel 31 is mounted to the rotating shaft 21. The transmission wheel 31 is rotated synchronously with the upright disc 22. The rotating wheel 32 is pivotally connected to the bracket 12. The resistance wheel 33 and the rotating wheel 32 are mounted coaxially and rotated synchronously. The belt 34 connects the transmission wheel 31 and the rotating wheel 32. The bracket 12 is provided with a first tension wheel 341 and a second tension wheel 342 to press against the belt 34 simultaneously to maintain the tightness of the belt 34. The resistance member 35 has a first end 351, a second end 352, and a connecting block 353. The first end 351 is pivotally connected to a pivoting block 128 of the bracket 12. The connecting block 353 is connected to the second end 352. The first elastic member 36 is connected between a first fixing block 126 of the bracket 12 and the connecting block 353. The first elastic member 36 provides a first return elastic force to the connecting block 353, so that the resistance member 35 has a kinetic energy toward the resistance wheel 33. The resistance member 35 is arc-shaped corresponding to the circular resistance wheel 33. The resistance member 35 is provided with a friction member 354 in an arc shape for contacting the resistance wheel 33 to generate friction resistance. The cable member 37 is connected between the connecting block 353 and the control member 38. The control member 38 is disposed on the bracket 12. The control member 38 can be rotated and positioned in a multi-stage manner. By the staged rotation and positioning of the control member 38, the cable member 37 will be pulled or released to drive the friction member 354 on the resistance member 35 to be in close contact with or in loose contact with or not in contact with the resistance wheel 33. The structure of the multi-stage rotation and positioning of the control member 38 is the prior art, for example, as disclosed in Taiwan Utility Model Publication No. 552959, so it will not be repeated hereinafter.

Figure 5:
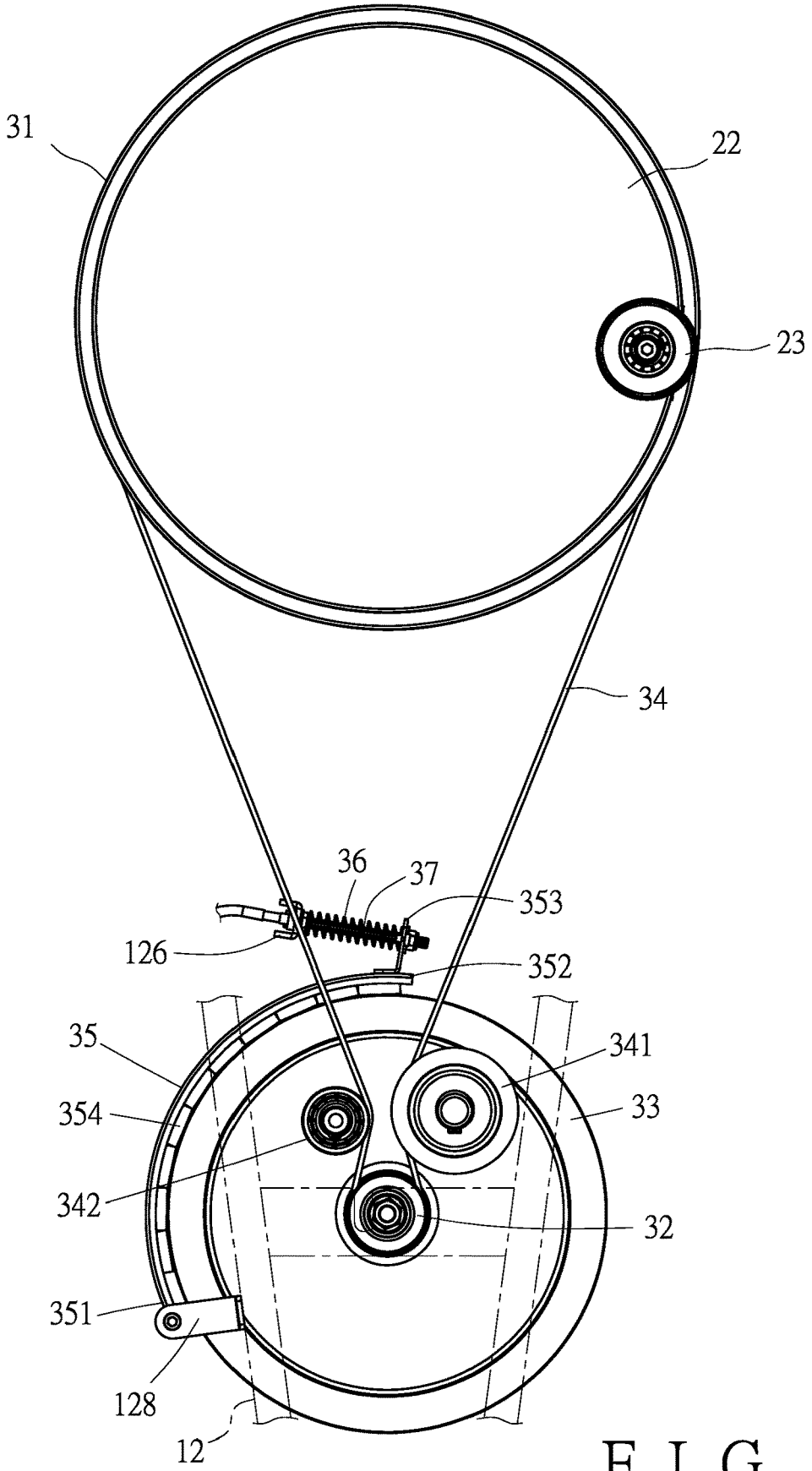
FIG. 5 is a front view of the upright rotating disc unit connected with the resistance unit of the present invention.
Figure 6:
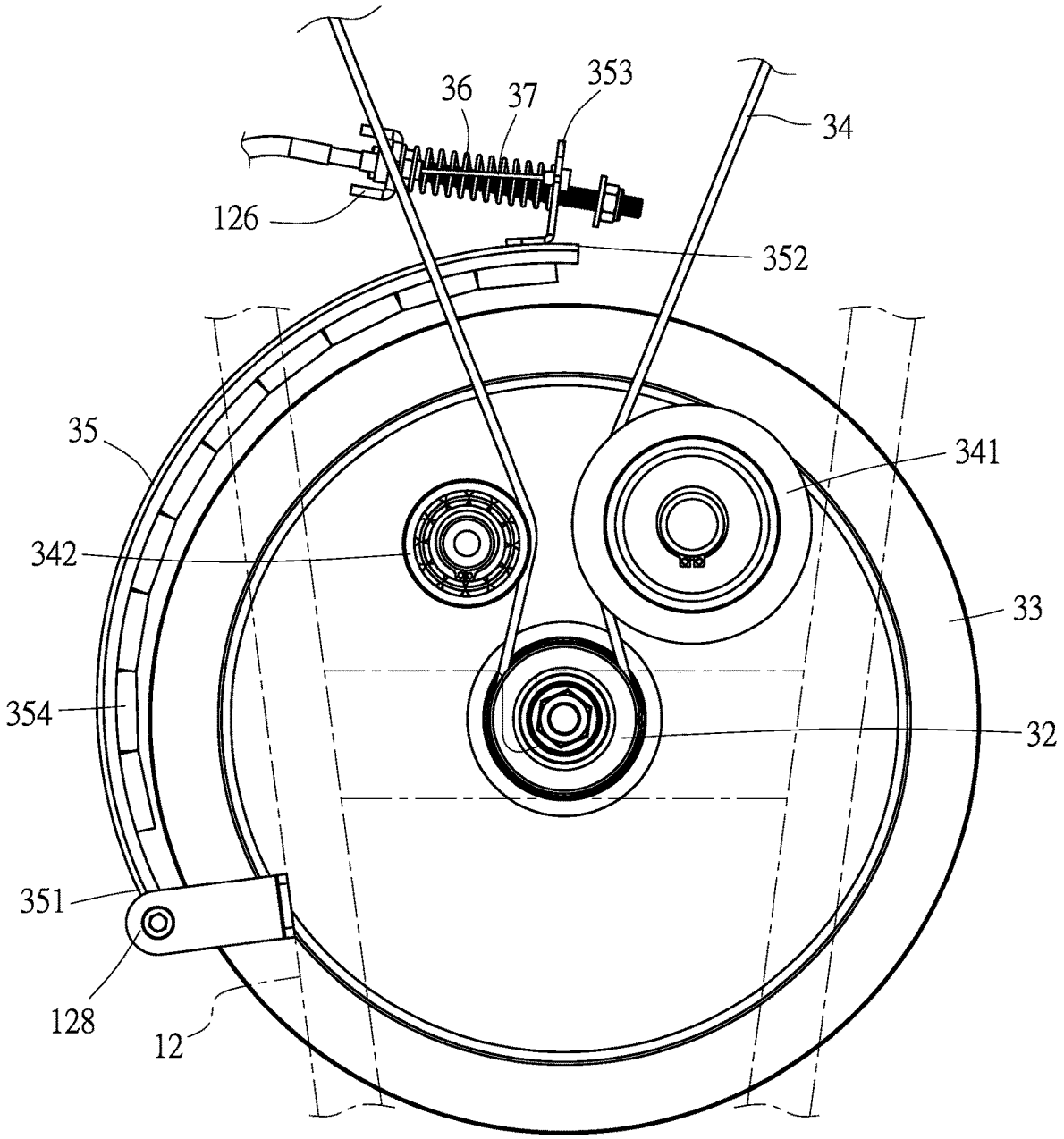
FIG. 6 is a partial enlarged view illustrating that the resistance member is moved away from the resistance wheel of the present invention.

When in use, both hands of the user hold the grips 23 to drive the upright discs 22 to turn, respectively. Each upright disc 22 turns the transmission wheel 31 through the rotating shaft 21. The transmission wheel 31 turns the rotating wheel 32 through the belt 34. The rotating wheel 32 synchronously drives the resistance wheel 33 to turn. The friction member 354 is pressed against the resistance wheel 33, enabling the resistance wheel 33 to generate a resistance. Referring to FIG. 5, when the friction member 354 of the resistance unit 3 is pressed against the resistance wheel 33 to provide a greater resistance effect at this time. Referring to FIG. 6, when the user adjusts the control member 38 (as shown in FIG. 2), the control member 38 pulls the connecting block 353 through the cable member 37, so that the friction member 354 of the resistance member 35 is moved away from the resistance wheel 33. When the friction member 354 of the resistance member 35 is not in contact with the resistance wheel 33, the rotation of the resistance wheel 33 will not be affected by the friction member 354 at all. At this time, the resistance of the resistance wheel 33 is minimum, and the training intensity is minimum. When the cable member 37 is released, the first return elastic force of the first elastic member 36 will push the connecting block 353, so that the friction member 354 of the resistance member 35 gradually abuts against the resistance wheel 33. The closer the friction member 354 is to the resistance wheel 33, the greater the resistance of the resistance wheel 33 and the greater the training intensity. The user can use the control member 38 to adjust the traction or release of the cable member 37 according to the training intensity as desired. Furthermore, the degree of contact between the friction member 354 and the resistance wheel 33 is adjusted to control the resistance of the resistance wheel 33. This embodiment is provided with two resistance units 3 to control the resistances of the two resistance wheels 33 respectively, so that the resistances of the two upright turning disc units 2 can be controlled to be the same or different. For users, when the resistances of the two upright turning disc units 2 are the same, the left training intensity and the right training intensity are the same; when the resistances of the two upright turning disc units 2 are different, the left training intensity and the right training intensity are different, that is, the left is strong and the right is weak, or, the left is weak and the right is strong. The exercise machine is suitable for a person who needs to strengthen the training intensity of the left upper limb or the right upper limb.

Figure 7:
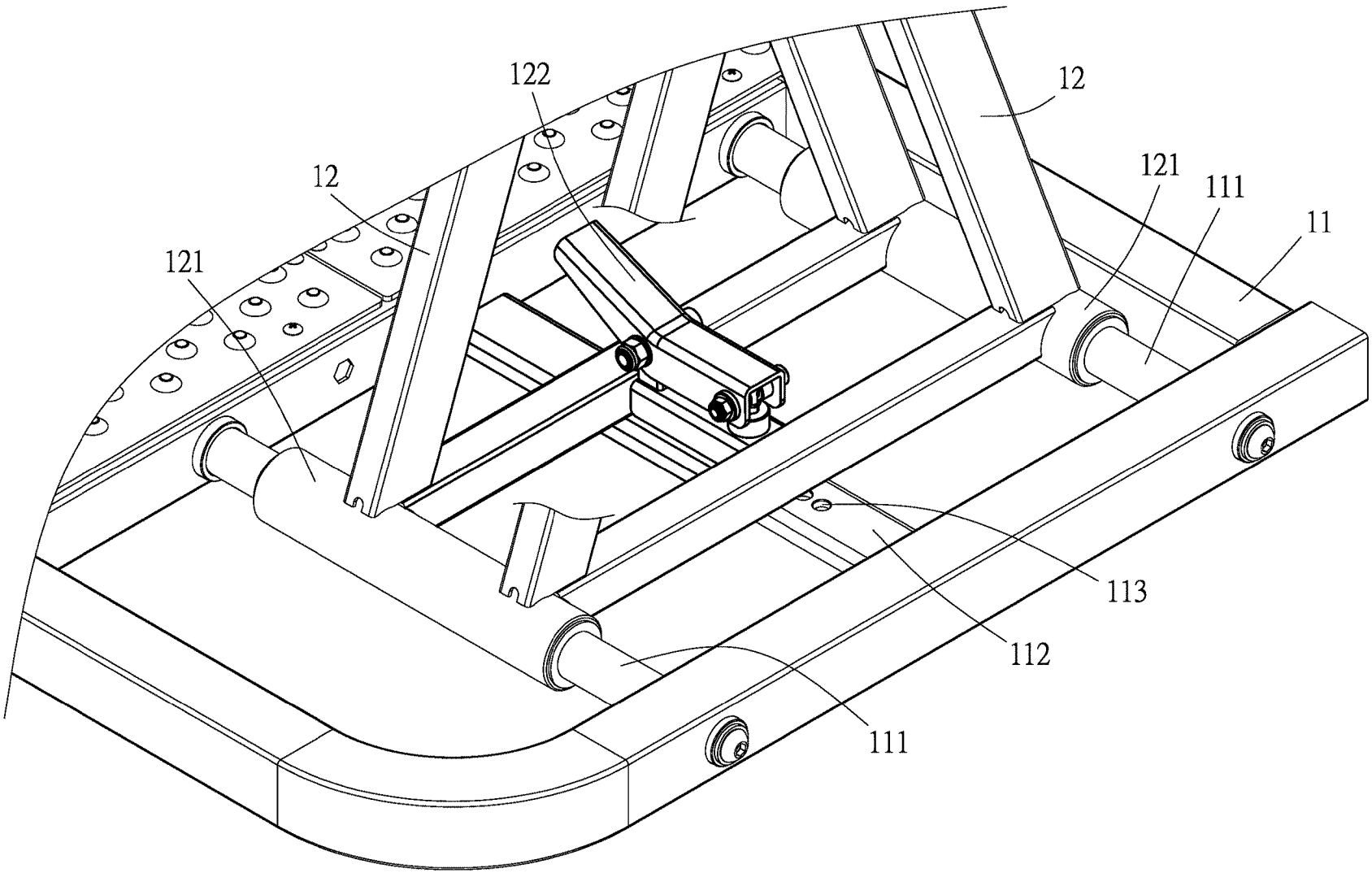
FIG. 7 is a partial enlarged view illustrating the bracket and the base of the present invention.
Figure 8:
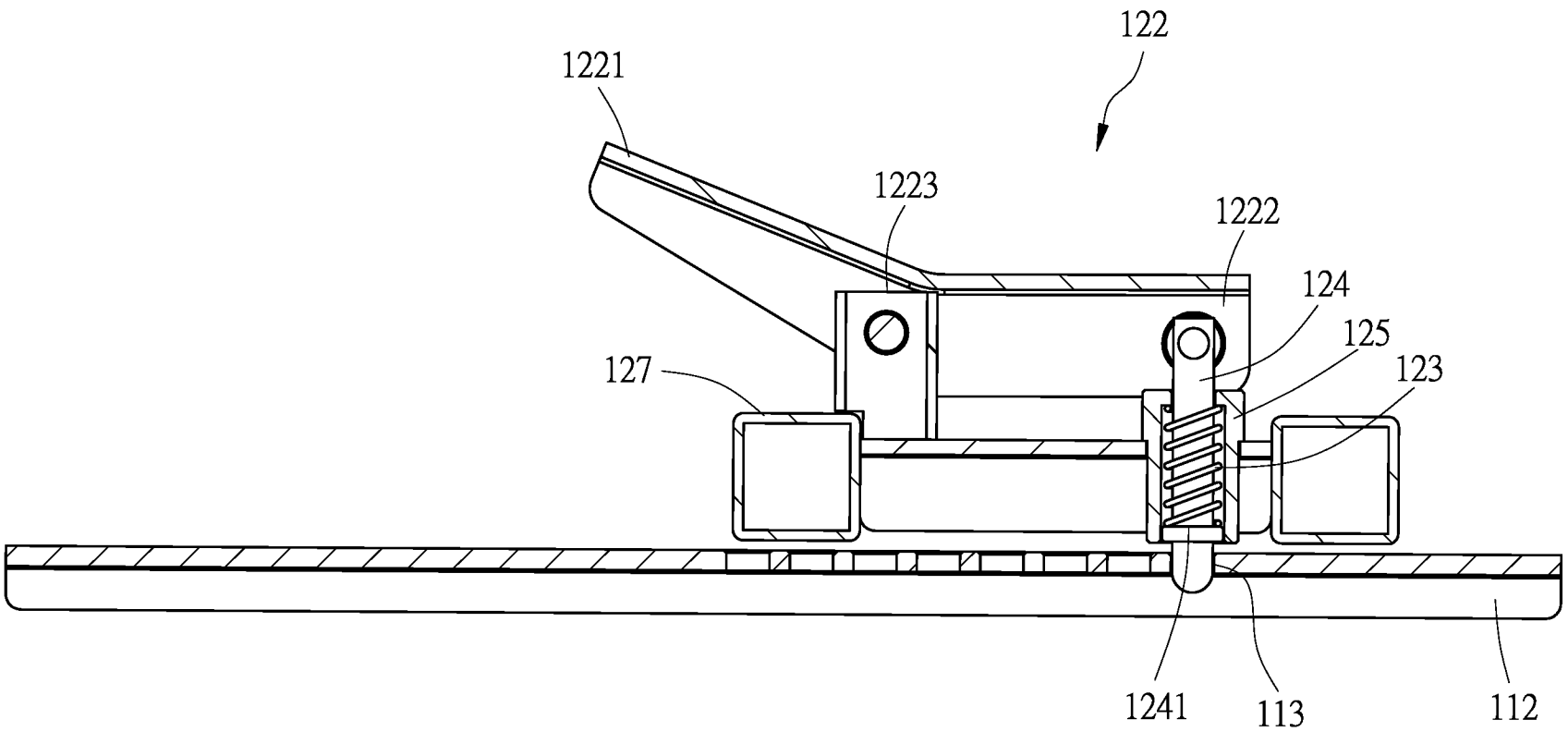
FIG. 8 is a cross-sectional view of the first fixing member and the second fixing member of the present invention.

Referring to FIG. 7 and FIG. 8, the two sides of the base 11 are provided with two guide rods 111 and a first fixing member along the horizontal direction. The first fixing member is a rod member 112. The rod member 112 has a plurality of fixing holes 113 arranged along the horizontal direction. The two guide rods 111 are disposed at two sides of the rod member 112. Each bracket 12 is provided with two first sleeves 121 and a second fixing member along the horizontal direction. The two first sleeves 121 are disposed on two sides of the second fixing member. The first sleeves 121 are sleeved on the guide rods 111, respectively. The second fixing member has a pressing member 122, a second elastic member 123, a fixing rod 124, and a second sleeve 125. The pressing member 122 has a pressing end 1221, a control end 1222, and a pivoting portion 1223. The pivoting portion 1223 is pivotally connected to a second fixing block 127 of the bracket 12. The second sleeve 125 is fixed to the second fixing block 127. The control end 1222 is pivotally connected to the fixing rod 124. The fixing rod 124 is inserted through the second sleeve 125 to extend into the corresponding fixing hole 113. The second elastic member 123 is disposed in the second sleeve 125, and the second elastic member 123 is sleeved on the fixing rod 124. The fixing rod 124 has a flange 1241. Two sides of the second elastic member 123 abut against the second sleeve 125 and the flange 1241, respectively, so that the second elastic member 123 gives the fixing rod 124 a second return elastic force toward the fixing hole 113.

Figure 9:
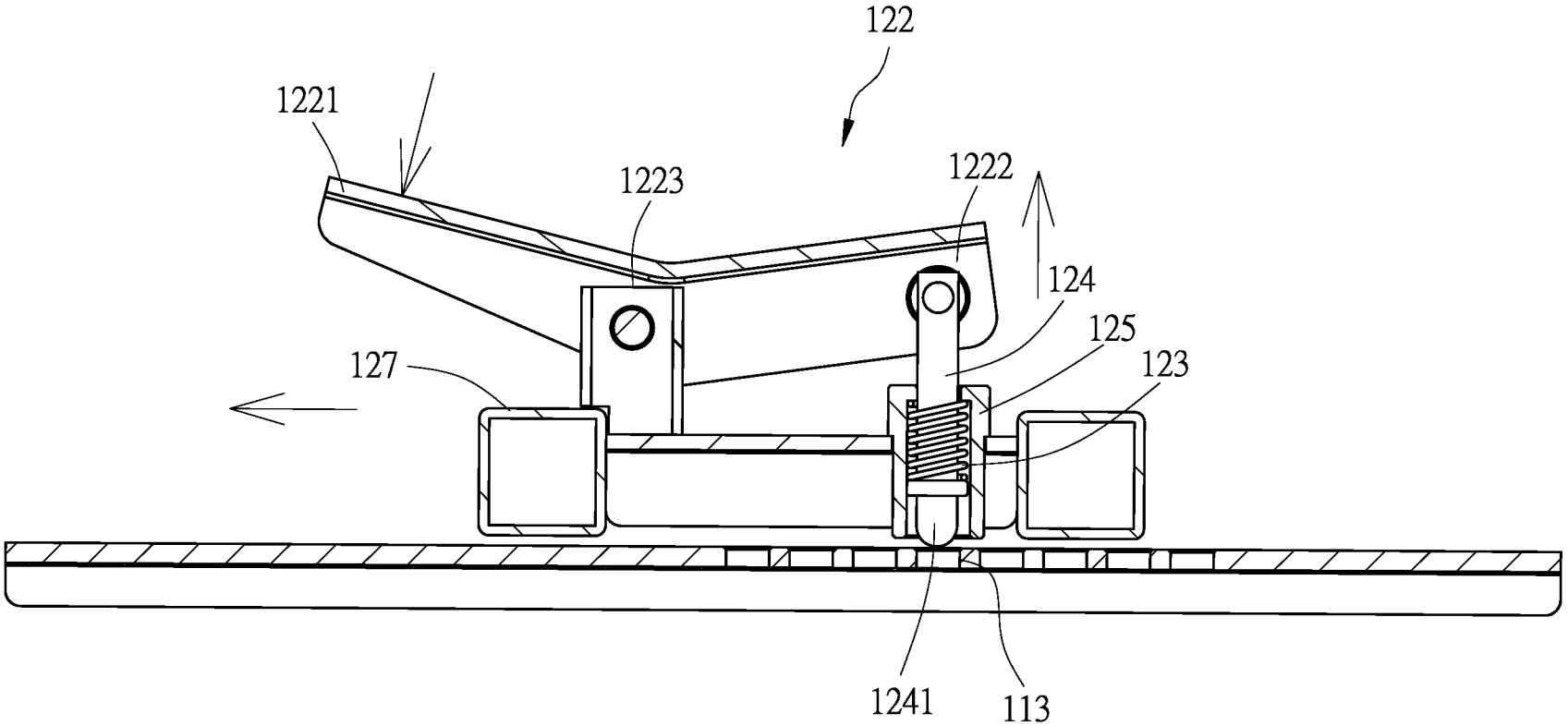
FIG. 9 is a schematic view illustrating that the fixing rod of the second fixing member of the present invention is moved away from the fixing hole.
Figure 10:
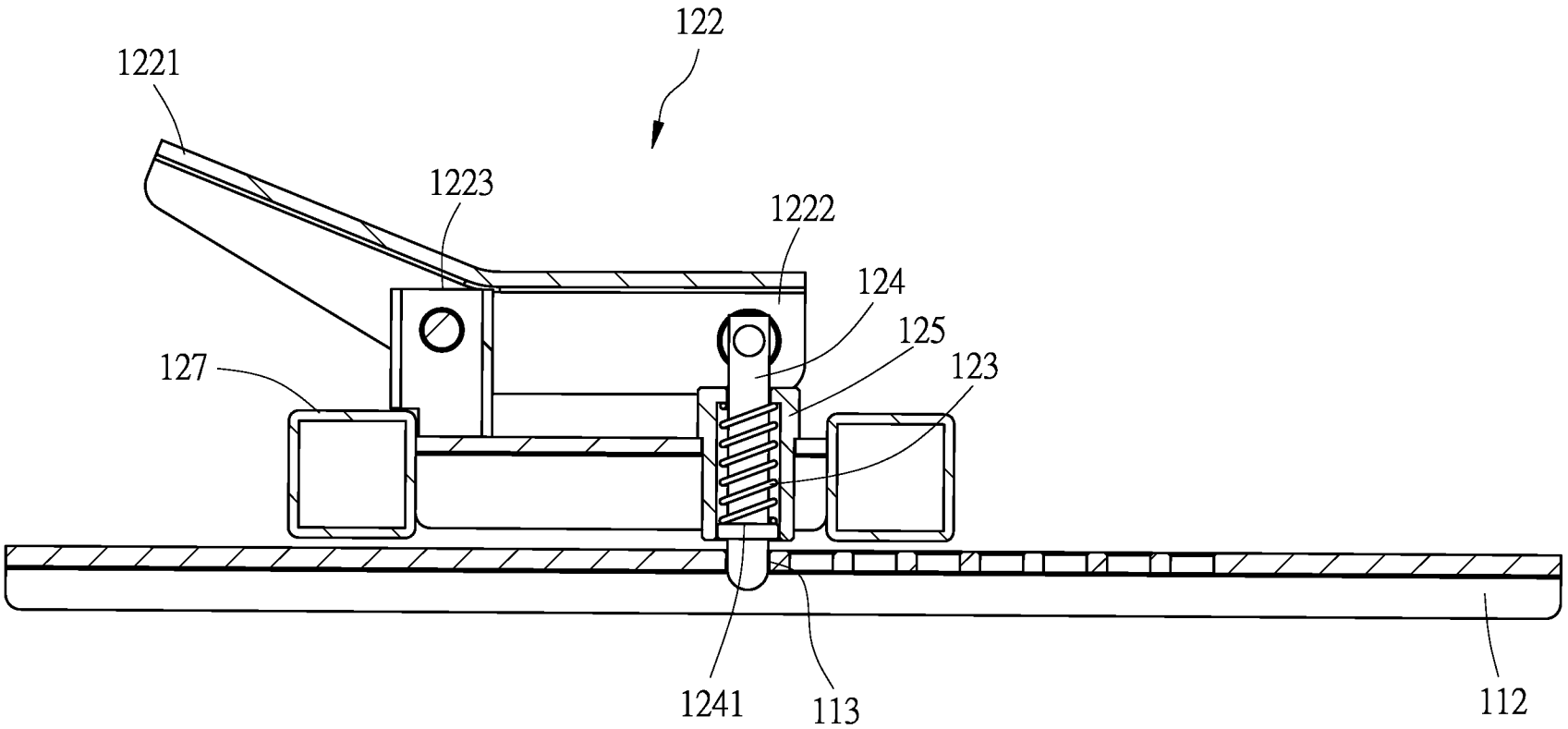
FIG. 10 is a schematic view illustrating that the fixing rod of the second fixing member of the present invention is inserted in another fixing hole.
Figure 11:
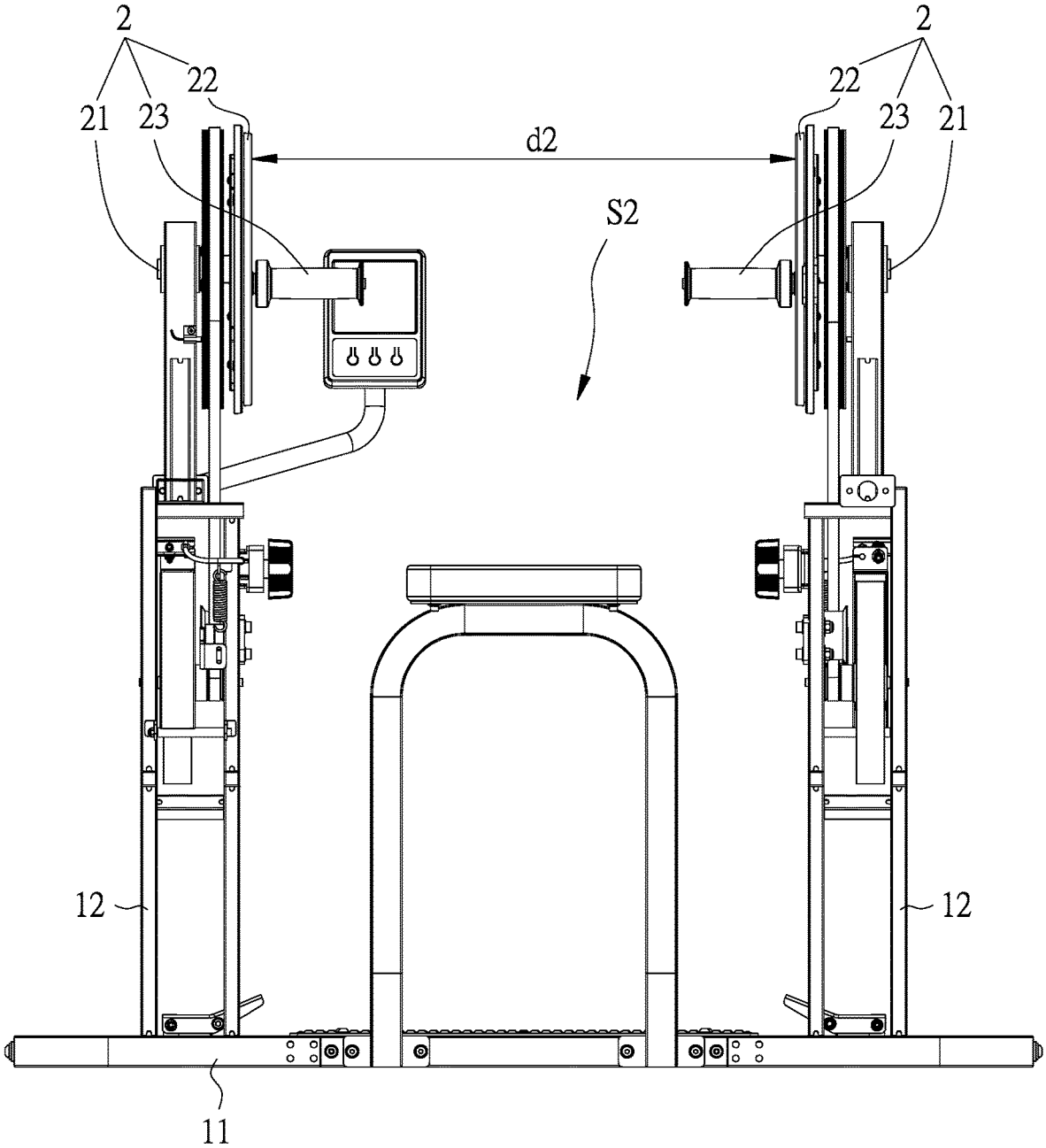
FIG. 11 is a front view of the symmetric upright rotating disc exercise machine of the present invention after the brackets are moved.

Referring to FIG. 9 and FIG. 10, when the pressing end 1221 is pressed, the pressing member 122 is pivoted on the second fixing block 127 through the pivoting portion 1223, the control end 1222 moves the fixing rod 124 toward the second sleeve 125 and away from the fixing hole 113 of the rod member 112. The flange 1241 is pressed against the second elastic member 123 to compress the second elastic member 123. The second elastic member 123 gives the fixing rod 124 a second return elastic force toward the fixing hole 113. The brackets 12 are movable on the two guide rods 111 through the two first sleeves 121, so that the two brackets 12 can be moved closer or farther away. In this embodiment, the two brackets 12 are moved close to each other. Referring to FIG. 10, when the pressing member 122 is moved to another fixing hole 113, the pressing end 1221 is released, so that the pressing member 122 is pivoted on the second fixing block 127 through the pivoting portion 1223. The control end 1222 moves the fixing rod 124 away from the second sleeve 125, and the second return elastic force of the second elastic member 123 returns the fixing rod 124. When the fixing rod 124 is inserted in another fixing hole 113 of the rod member 112, the bracket 12 is fixed to the base 11. With reference to FIG. 2 and FIG. 11, when the two brackets 12 are close to each other, a smaller second distance d2 and a smaller second operation space S2 are defined between the two upright rotating disc units 2 for a thin and small user.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A symmetric upright rotating disc exercise machine, comprising:

a base unit; and two upright rotating disc units, each upright rotating disc unit including a rotating shaft, an upright disc and a grip, the rotating shaft being pivotally connected to the base unit in a horizontal direction, the upright disc being mounted to the rotating shaft, the upright discs of the two upright rotating disc units being arranged to face each other, the two upright rotating disc units being separated from each other by a distance in the horizontal direction to form an operation space, each grip being mounted to a respective upright disc and located in the operation space, wherein the base unit includes a base and two brackets, the two upright rotating disc units are respectively disposed on the two brackets, and the two brackets are respectively movably disposed on two sides of the base so that the two brackets can be displaced along the horizontal direction to change the distance.

2. The symmetric upright rotating disc exercise machine as claimed in claim 1, wherein the base includes a slide rail and a first fixing member, each bracket includes a slide block and a second fixing member, the slide block is connected to the slide rail, the second fixing member corresponds to the first fixing member, the slide block is movable on the slide rail to drive the two brackets to move along the horizontal direction, and the two brackets are secured to the base through the second fixing member to be fixed to the first fixing member.

3. The symmetric upright rotating disc exercise machine as claimed in claim 2, wherein the slide rail is provided with a guide rod extending along the horizontal direction, the slide block is provided with a sleeve extending along the horizontal direction, the sleeve is sleeved on the guide rod, and the sleeve is movable on the guide rod to drive the two brackets to move along the horizontal direction.

4. The symmetric upright rotating disc exercise machine as claimed in claim 2, wherein the first fixing member is a rod member extending along the horizontal direction, the rod member has a plurality of fixing holes arranged along the horizontal direction; the second fixing member has a pressing member, a second elastic member and a fixing rod, the pressing member has a pressing end, a control end and a pivoting portion, the pivoting portion is pivotally connected to the bracket, the control end is connected to the fixing rod, the second elastic member is sleeved on the fixing rod, the fixing rod has a flange, the second elastic member is connected between the control end and the flange; when the fixing rod is inserted one of the fixing holes, the two brackets are fixed to the base, when the pressing end is pressed, the fixing rod is moved away from the fixing hole to release the two brackets from the base.

5. The symmetric upright rotating disc exercise machine as claimed in claim 1, further comprising a seat disposed on the base, the seat being located on either side of the operation space and being away from the two upright rotating disc units.

6. The symmetric upright rotating disc exercise machine as claimed in claim 1, further comprising a display unit disposed on the base unit.

7. A symmetric upright rotating disc exercise machine, comprising:

a base unit;

two upright rotating disc units, each upright rotating disc unit including a rotating shaft, an upright disc and a grip, the rotating shaft being pivotally connected to the base unit in a horizontal direction, the upright disc being mounted to the rotating shaft, the upright discs of the two upright rotating disc units being arranged to face each other, the two upright rotating disc units being separated from each other by a distance in the horizontal direction to form an operation space, each grip being mounted to a respective upright disc and located in the operation space; and two resistance units disposed on the base unit, the two resistance units being respectively connected to the two upright rotating disc units, each resistance unit including a transmission wheel, a resistance wheel, a belt, a resistance member, a first elastic member, a cable member and a control member, the transmission wheel being mounted to the rotating shaft, the resistance wheel being pivotally connected to the base unit, the belt connects the transmission wheel and the resistance wheel, the resistance member having a first end and a second end, the first end being pivotally connected to the base unit, the first elastic member being connected between the base unit and the second end, the resistance member corresponds to the resistance wheel, the cable member being connected between the second end and the control member, the control member being disposed on the base unit, and the control member being configured to pull the resistance member through the cable member for controlling the resistance member to be in contact with the resistance wheel.

8. The symmetric upright rotating disc exercise machine as claimed in claim 7, wherein the base unit includes a base and two brackets, the two upright rotating disc units are respectively disposed on the two brackets, and the two brackets are respectively movably disposed on two sides of the base so that the two brackets can be displaced along the horizontal direction to change the distance.

9. The symmetric upright rotating disc exercise machine as claimed in claim 8, wherein the base includes a slide rail and a first fixing member, each bracket includes a slide block and a second fixing member, the slide block is connected to the slide rail, the second fixing member corresponds to the first fixing member, the slide block is movable on the slide rail to drive the two brackets to move along the horizontal direction, and the two brackets are secured to the base through the second fixing member to be fixed to the first fixing member.

10. The symmetric upright rotating disc exercise machine as claimed in claim 9, wherein the slide rail is provided with a guide rod extending along the horizontal direction, the slide block is provided with a sleeve extending along the horizontal direction, the sleeve is sleeved on the guide rod, and the sleeve is movable on the guide rod to drive the two brackets to move along the horizontal direction.

11. The symmetric upright rotating disc exercise machine as claimed in claim 9, wherein the first fixing member is a rod member extending along the horizontal direction, the rod member has a plurality of fixing holes arranged along the horizontal direction; the second fixing member has a pressing member, a second elastic member and a fixing rod, the pressing member has a pressing end, a control end and a pivoting portion, the pivoting portion is pivotally connected to the bracket, the control end is connected to the fixing rod, the second elastic member is sleeved on the fixing rod, the fixing rod has a flange, the second elastic member is connected between the control end and the flange; when the fixing rod is inserted one of the fixing holes, the two brackets are fixed to the base, when the pressing end is pressed, the fixing rod is moved away from the fixing hole to release the two brackets from the base.

12. The symmetric upright rotating disc exercise machine as claimed in claim 8, further comprising a seat disposed on the base, the seat being located on either side of the operation space and being away from the two upright rotating disc units.

13. The symmetric upright rotating disc exercise machine as claimed in claim 7, further comprising a display unit disposed on the base unit.

* * * * *